United States Patent [19]

Walters et al.

[11] 4,211,153

[45] Jul. 8, 1980

[54] CARTON ERECTING APPARATUS

[75] Inventors: Robert W. Walters, Caldwell; James Nylander, Budd Lake, both of N.J.

[73] Assignee: Container Equipment Corporation, Cedar Grove, N.J.

[21] Appl. No.: 933,823

[22] Filed: Aug. 15, 1978

[51] Int. Cl.[2] ..... B31B 1/76

[52] U.S. Cl. ..... 93/53 SD; 93/53 BF

[58] Field of Search ..... 93/53 SD, 53 M, 53 R, 93/53 BF; 271/95, 94, 96; 53/566, 564, 459

[56] References Cited

U.S. PATENT DOCUMENTS

| | | | |
|---|---|---|---|
| 3,242,827 | 3/1966 | Winters | 93/53 M |
| 3,599,541 | 5/1969 | Allen | 271/95 |
| 3,858,490 | 1/1975 | Heisler | 93/53 SD |

*Primary Examiner*—R. L. Spruill
*Assistant Examiner*—K. Y. Lin
*Attorney, Agent, or Firm*—Kenyon & Kenyon

[57] ABSTRACT

The cartoner utilizes a rotary feeder to pick-up a carton blank on a dead stop from a hopper; to break the carton on itself on a breaking plate during movement in an arcuate path from the hopper; and to deposit the blank on a dead stop on a conveyor. The rotary feeder continuously rotates and uses various means to stop the motion of the carton blank during travel from the hopper to the conveyor.

22 Claims, 14 Drawing Figures

123
124
120
17
115
117
116
119
114
101
104
103
111
109
39
25
51
41
112
106
108
107
108
100
26
43
46
59
58
26
12
91
41
59
71
46
128
46
41
59
92
26
93
17
94

Fig. 6.
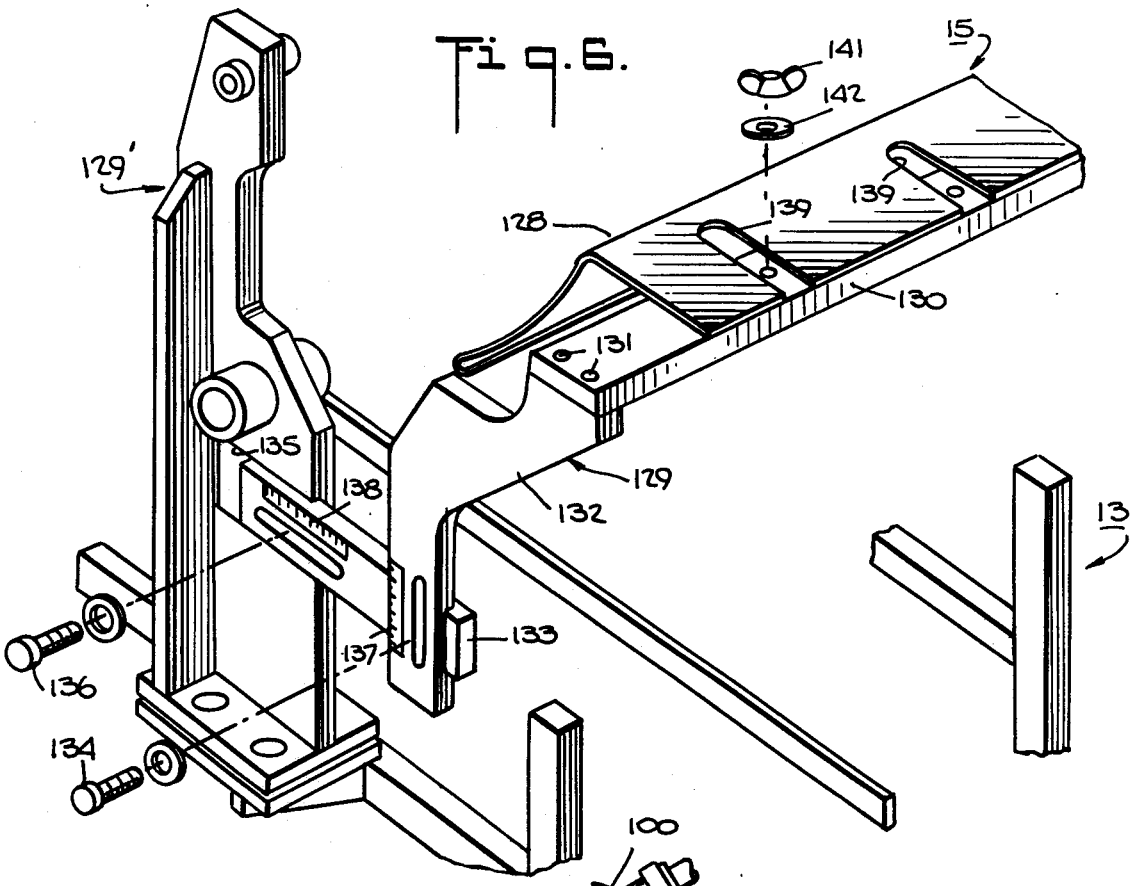
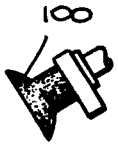
Fig 7.
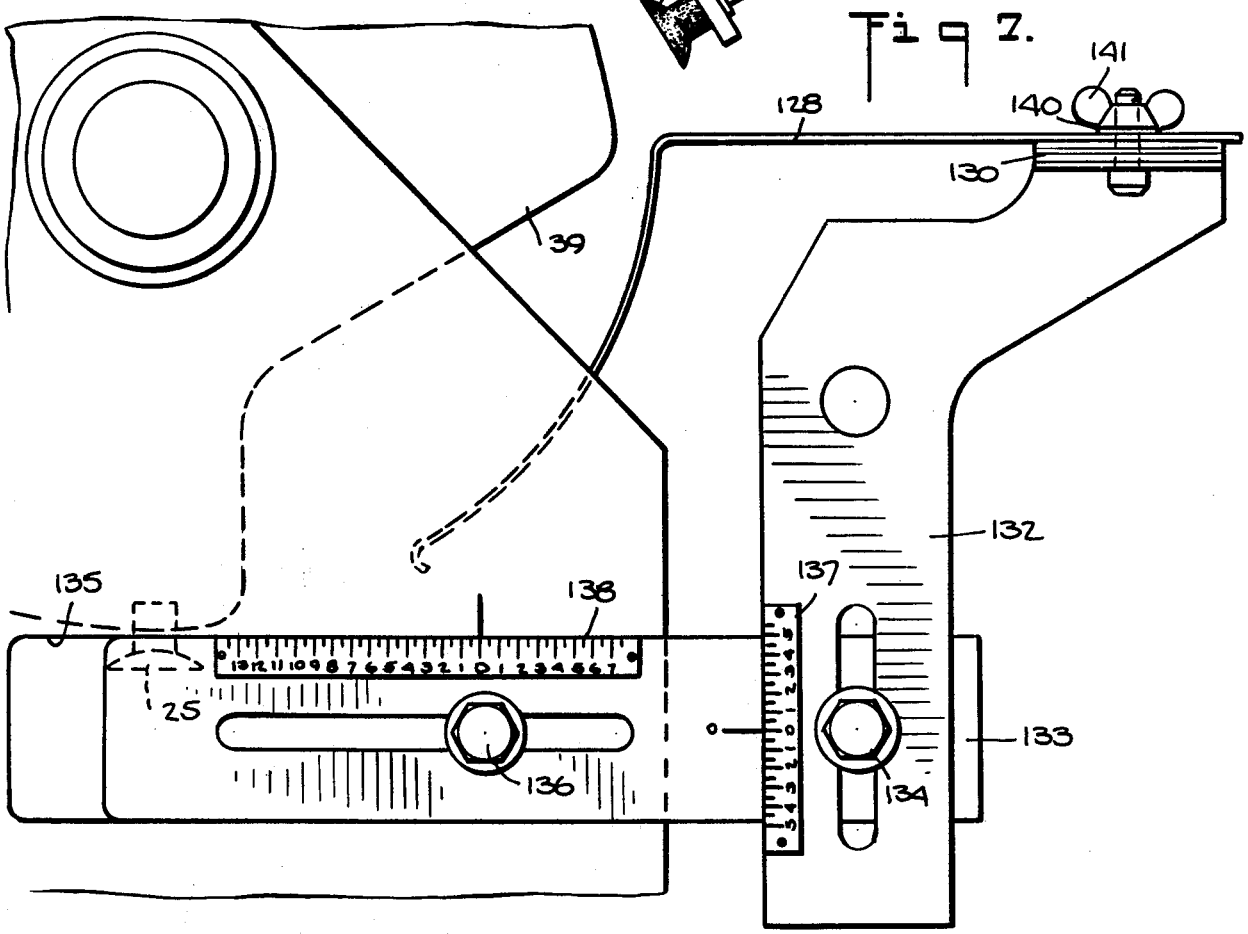

Fig. 8.
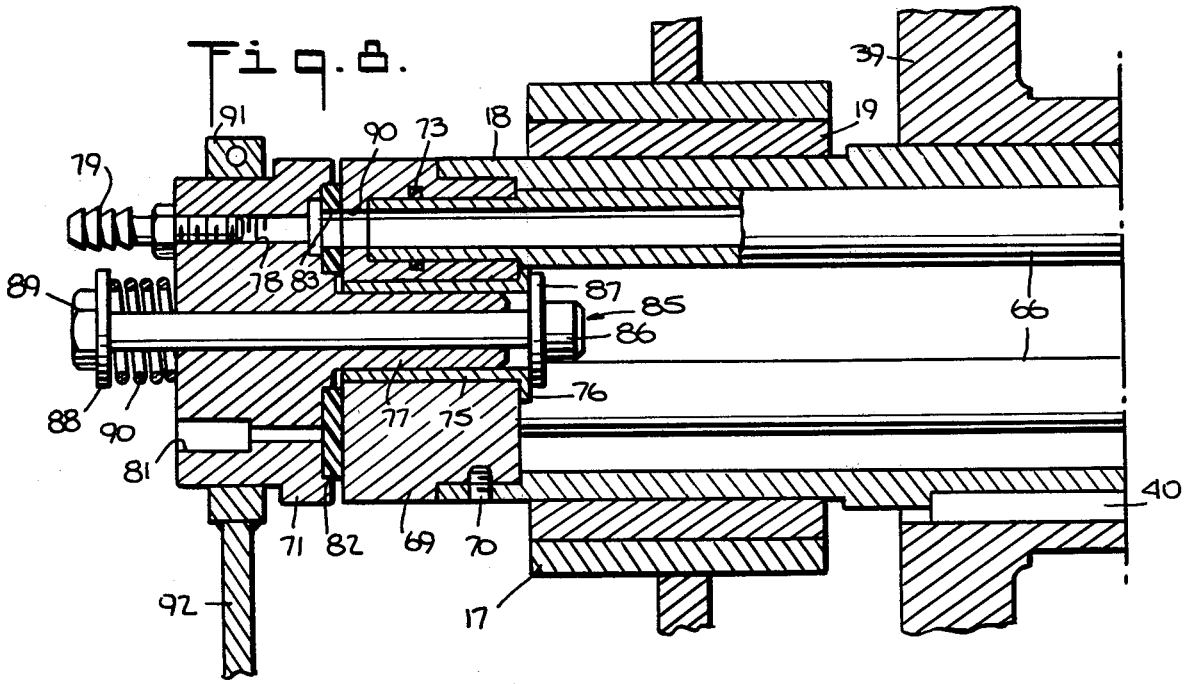
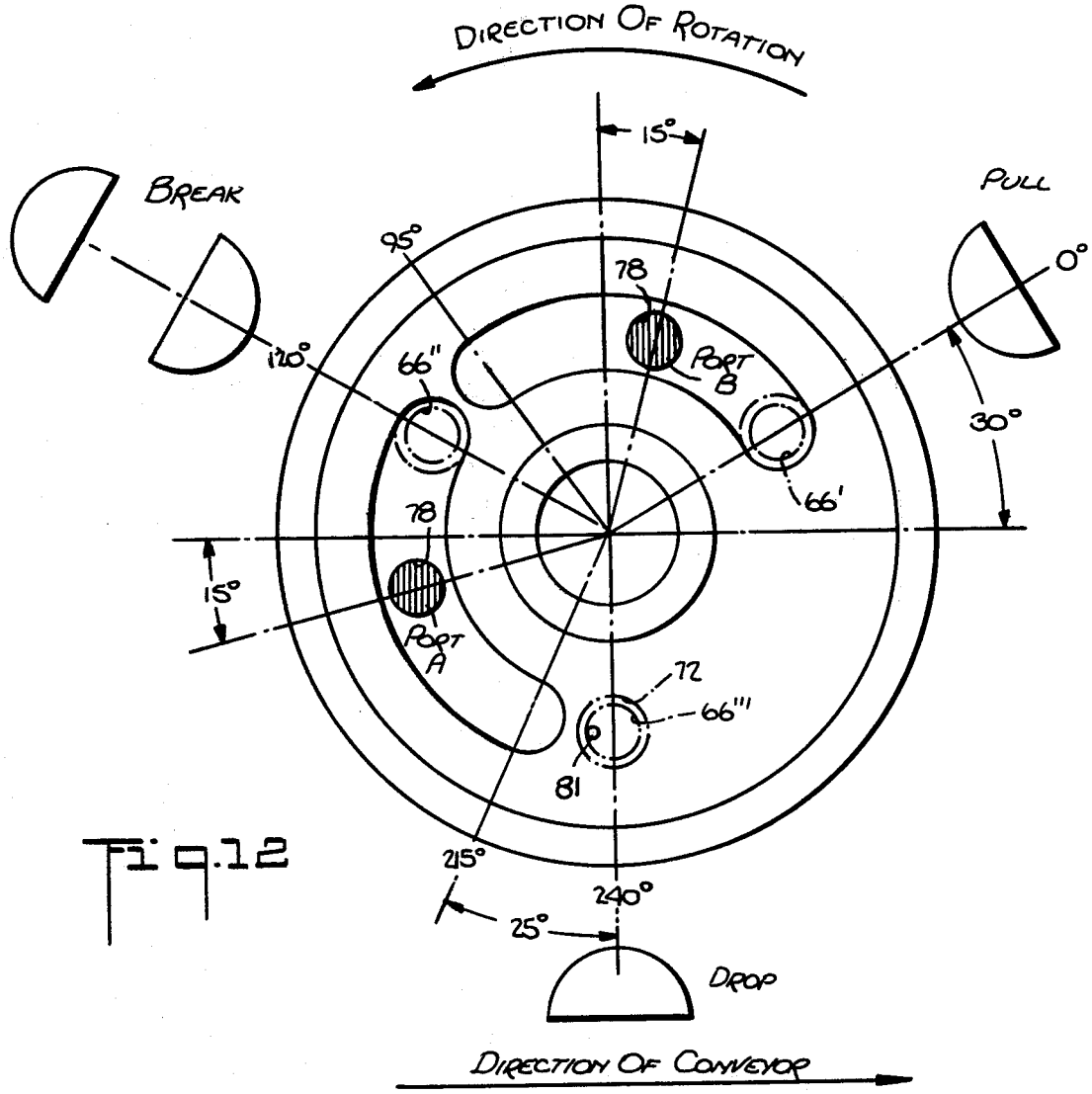
Fig. 12

120°
120°
120°
69
76
71
78
80
77
81
84
82
83
72
85
87
86
88
89
90
66
20°
45°
15°
35°
30°
6°

Timing Chart
No Prod
1 Rev Cam
No Prod Single
Wheel Cup Movement
Vac
No Vac
Wheel Port A
No Vac
Vac Wheel Port B Only
No Vac
Vac In Wheel Ports A+B
Break Cups (100)
Wheel Cups (25)
1" Wheel Cupprise
0°
90°
120°
180°
240°
270°
335°
360°
Degrees Rotation Of Cam Wheel
Component Functions

CARTON ERECTING APPARATUS

This invention relates to a cartoner. More particularly, this invention relates to a cartoner for feeding carton blanks from a hopper to a conveyor.

As is known, various types of machines have been used for opening carton blanks from a flattened condition to an open condition for filling with various items at a filling station. In some cases, the machines have been constructed to feed a series of flattened carton blanks from a hopper directly onto a conveyor. Generally, these machines have cams in the form of elongated strips along the conveyor for opening up the blanks from the flattened condition to the open condition. However, in cases where the blanks are not properly aligned with the cams, the blanks have failed to open. As a result, various controls are needed to prevent the feeding of an item into the space occupied by the unopened carton blank at the filling station. Further, unless removed, an unopened blank may cause the following blanks to also misalign or may cuase jamming of the conveyor.

It is also known that when carton blanks are shipped in bulk in a flattened condition, the blanks tend to stay in a flattened condition and work against the opening cams of a cartone conveyor. In order to overcome this tendency, additional cams are sometimes provided on the conveyor to more positively open the blanks. However, as above, if the blanks are misaligned with the cams, the blanks may not be properly opened. This can result in jamming of the machine or, at least, in some down-time in order to remove the mis-aligned blanks or to prevent items from being fed into the filling station.

Accordingly, it is an object of the invention to provide a cartoner for conveying flattened carton blanks to a conveyor in a reliable manner.

It is another object of the invention to overcome the tendency of a flattened carton blank to remain flat during conveyance in a cartoner.

It is another object of the invention to provide a relatively simple means of breaking a carton blank on itself during conveyance.

It is another object of the invention to provide a relatively simple continuously operator feeder for picking up carton blanks on a dead stop.

It is another object of the invention to provide a relatively simple technique for feeding carton blanks to a conveyor of a cartoner.

Breifly, the invention provides a cartoner which comprises a conveyor, a hopper for supplying blanks to the conveyor, a feeder for sequentially feeding blanks from the hopper through an arcuate path to an input end of the conveyor and a breaking means in the arcuate path of a carton for breaking the carton on itself.

The conveyor may be of any suitable construction for conveying a series of carton blanks sequentially from the input end to a filling or packaging station. For example, the conveyor may be provided with cams for opening a received carton blank into a condition suitable for receiving an item to be packaged at the filling station.

The hopper may also be of any suitable construction for supplying blanks and is disposed above the conveyor in an inclined manner in order to define an acute angle with the conveyor. As such, the overall floor space required for the cartoner can be held to a minimum.

The feeder is a rotary feeder and is positioned between the hopper and the conveyor for feeding blanks from the hopper to the conveyor. The feeder has a continuously rotatable shaft and sets of suction cups which are circumferentially mounted about the shaft in order to pick up a blank at the hopper, to break the blank on the breaking means and to deposit the broken blank on the conveyor. To this end, a means is provided for moving the suction cups radially of the shaft between a rest position and a radially extended position during rotation of the shaft. This latter means includes various cams and discs which are interrelated to each other such that the rotary motion of the suction cups is stilled during pick-up, breaking and depositing while the motion of the shaft continues. This permits a carton blank to be picked up, broken and deposited without any rotary motion. This, in turn, permits an accurate pick-up and placement of a carton blank.

The cartoner also utilizes a pneumatic means for drawing a vacuum in the suction cups. For this purpose, the pneumatic means employs at least one vacuum tube within the shaft, a means for selectively drawing a vacuum in the vacuum tube and a plurality of flexible conduits which extend from the vacuum tube to the suction cups in order to communicate the suction cups with the vacuum tube. The means for selectively drawing the vacuum includes a rotary joint at one end of the shaft to connect the vacuum tube to a vacuum source while allowing rotation of the shaft.

In order to aid the breaking of the carton blank at the breaking means, the feeder also employs an additional set of suction cups. These latter cups are mounted above the breaking means and are directed towards the shaft of the feeder in order to engage a carton blank on a side opposite from the suction cups mounted on the feeder shaft. In addition, means are provided for moving this additional set of suction cups towards the shaft when a carton blank approaches the breaking means in order to engage the blank. The motion of the opposed sets of suction cups towards each other is carried out on a dead-stop of the blank in order to have the blank firmly engaged therebetween.

When in use, the cartoner picks up a blank from the hopper with the suction cups at a dead stop. After pick up, the suction cups are moved forwardly relative to the rotating feeder shaft to make up for the rotary displacement loss during the dead stop. Thereafter, as the blank approaches the breaking means the suction cups are again moved radially outwardly of the feeder shaft while the suction cups on the other side of the blank are moved towards the blank. During this dead stop time, the blank becomes firmly engaged with the additional set of suction cups. Thereafter, the suction cups are again moved forwardly relative to the feeder shaft to pull the blank open and to permit breaking of the carton blank on itself by impingement against the breaking means. Continued motion of the feeder shaft brings the blank into a position for depositing onto the conveyor. At this latter position, the suction cups are again moved radially outwardly of the feeder shaft on a dead stop basis to eposit the blank directly onto the conveyor. Thereafter, the suction cups are again moved forwardly relative to the rotating feeder shaft to again bring the suction cups and shaft into unitary movement.

These and other objects and advantages of the invention will become more apparent from the following detailed description taken in conjunction with the drawings in which:

FIG. 6 illustrates a breaking means and an adjustment therefore in accordance with the invention;

FIG. 7 illustrates a side view of the breaking means and adjustment means of FIG. 6;

FIG. 8 illustrates a cross-sectional view of a rotary joint in accordance with the invention;

FIG. 12 illustrates a schematic view of the male member of the rotary joint relative to the working positions of the rotary feeder;

FIG. 13 illustrates a perspective view of the motions of a carton blank during conveyance on a rotary feeder in accordance with the invention.

Figure 1:
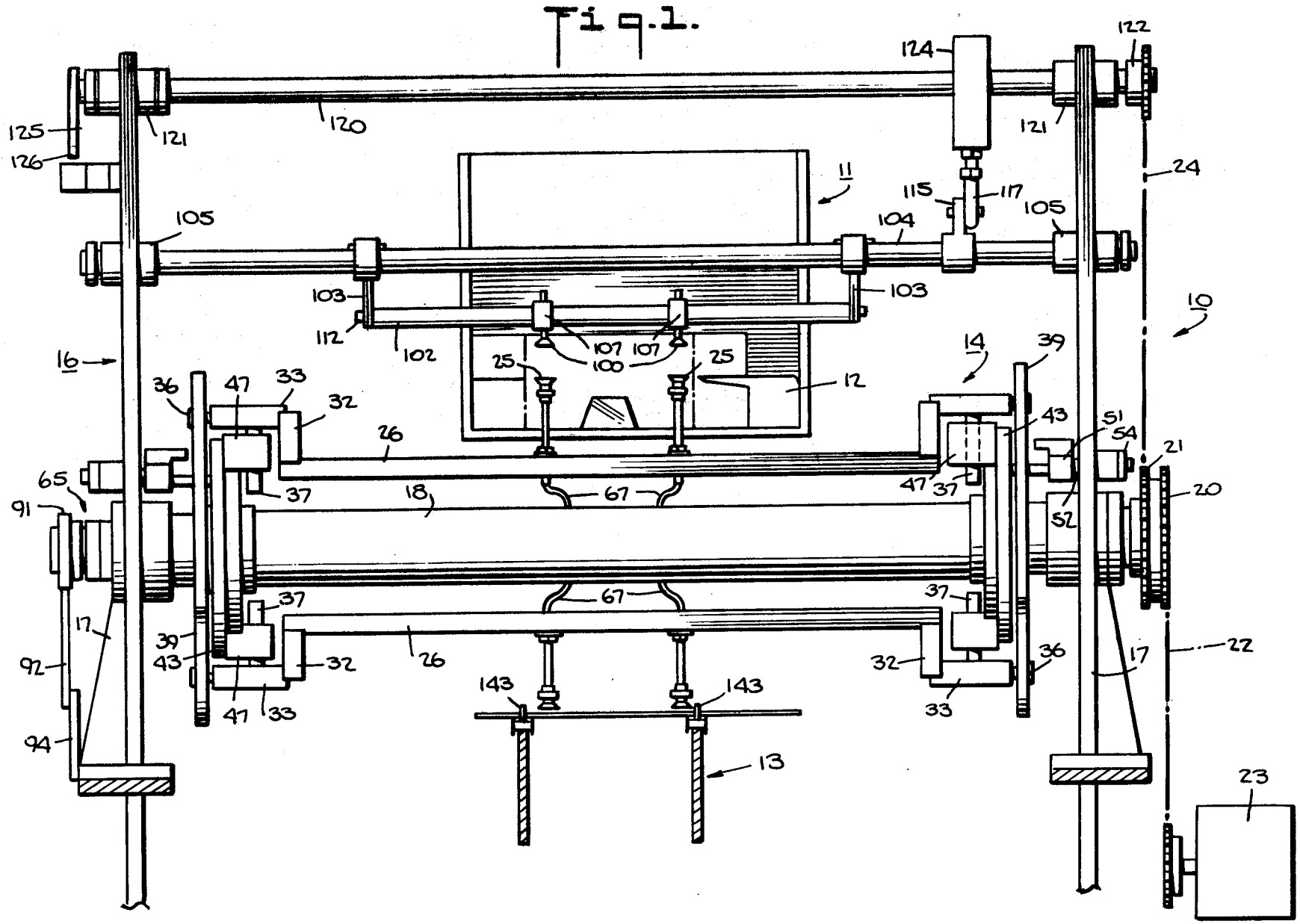
FIG. 1 illustrates an end view of a cartoner according to the invention employed with a hopper and a conveyor.
Figure 4:
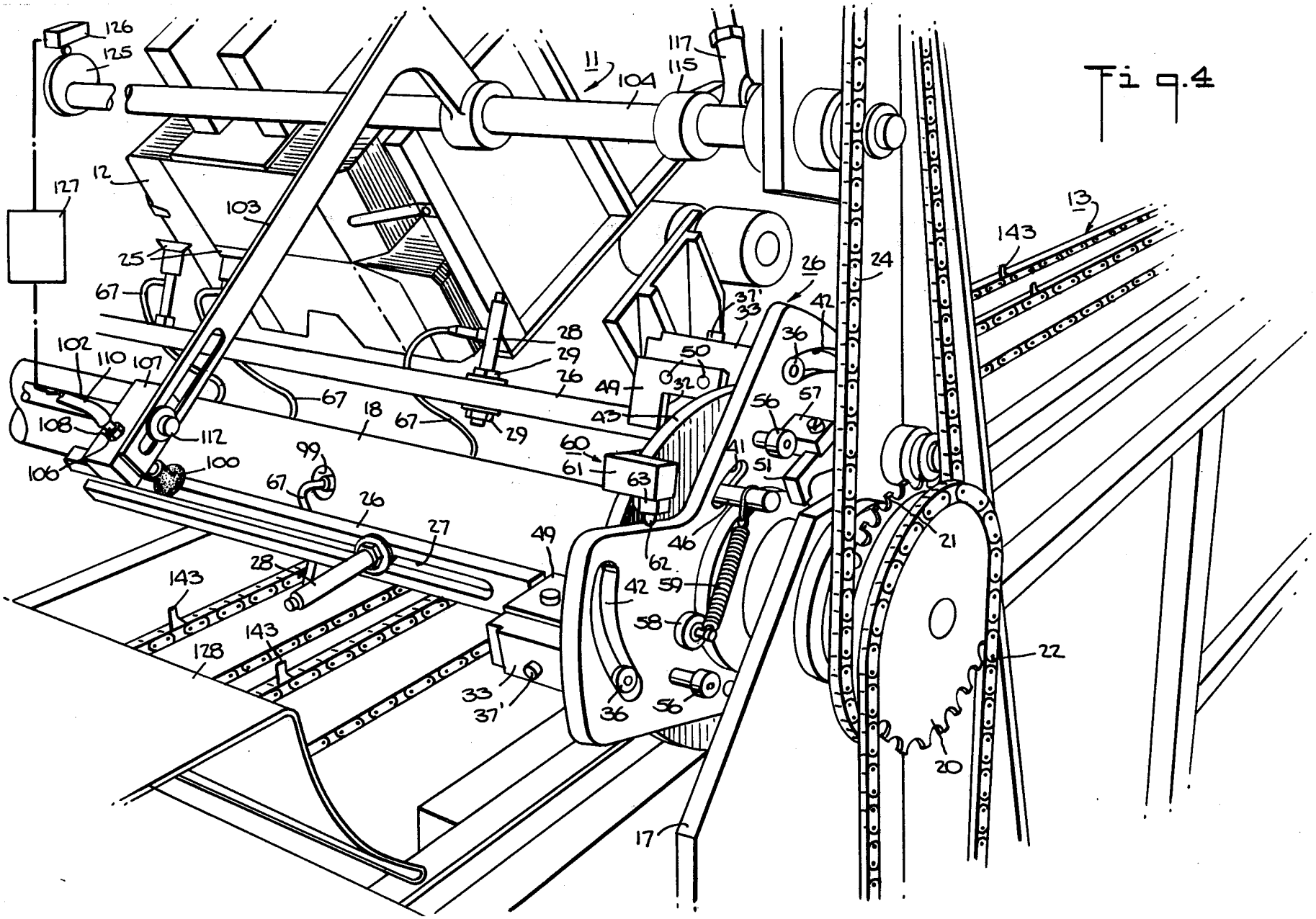
FIG. 4 illustrates a perspective view of a portion of the cartoner in accordance with the invention.

Referring to FIGS. 1 and 4, the cartoner 10 includes a hopper 11 for supplying flattened carton blanks 12, a conveyor 13 of generally known construction for conveying a series of the carton blanks 12 sequentially from an input end to a filling or packaging station (not shown); and a feeder 14 for sequentially feeding the blanks 12 from the hopper 11 to the conveyor 13. The conveyor 13 is provided with suitable cams (not shown) for opening the blanks 12 into opened condition to receive goods at the filling station. Since the conveyor 13 is of generally conventional structure, no further description is believed to be necessary. As shown in FIG. 4, the hopper 11 is disposed above the conveyor 13 at an incline to define an acute angle therebetween. The feeder 14 which is a rotary feeder is disposed between the hopper 11 and the conveyor 13 within this acute angle and is disposed to move the carton blanks 12 from the hopper 11 through an arcuate path to the input end of the conveyor 13.

Figure 3:
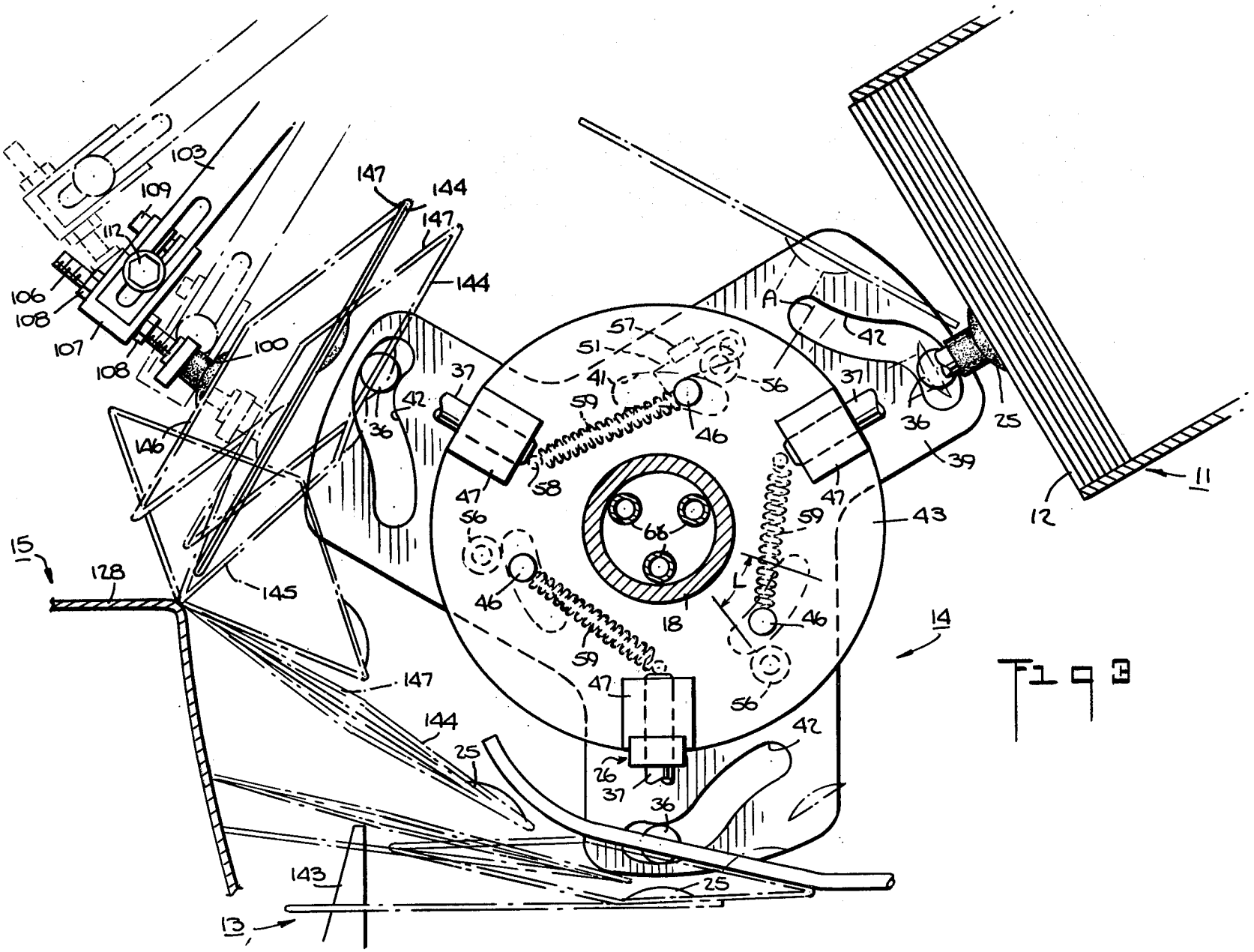
FIG. 3 illustrates a side view of a rotary feeder of FIG. 2 showing various positions of a carton blank in phantom.

In addition, as shown in FIG. 3, a breaking means 15 is disposed in the arcuate path of the cartons 12 for breaking each carton blank 12 impinging thereon on itself. In this regard, the terminology "breaking a carton blank on itself" is intended to mean that the carton blank is opened from an initial flattened position and then closed on itself in a position different from the initial position. (See FIG. 3)

Figure 5:
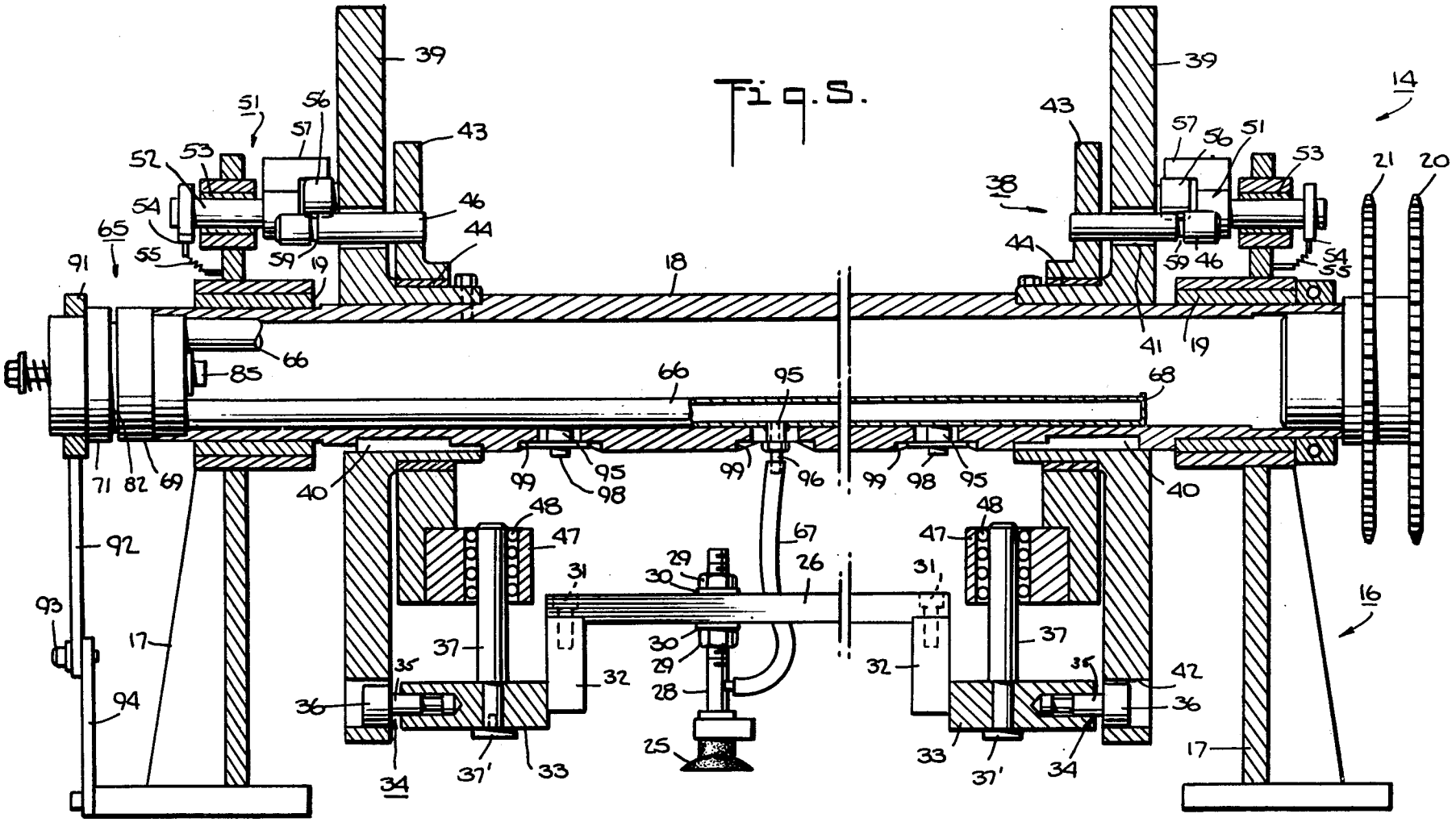
FIG. 5 illustrates a partial cross-sectional view of the rotary feeder according to the invention.

Referring to FIGS. 4, and 5 the rotary feeder 14 includes a frame 16 which has a pair of vertical supports 17 on opposite sides of the conveyor 13 and a hollow rotatable shaft 18 which is rotatably mounted at each end in the supports 17 via a suitable bearing, such a bronze sleeve bearing 19. As shown in FIGS. 4 and 5, one end of the shaft 18 extends outwardly of the frame 16 and carries two sprockets 20, 21. One sprocket 20 meshes with a chain 22 so as to be driven from a main shaft of the machine via a reversing gear 23 (FIG. 1) while the other sprocket 21 meshes with a chain 24 for purposes as described below.

The rotary feeder 14 also employs three sets of suction cups 25 which are mounted circumferentially about the shaft 18 in equi-spaced relation for rotation therewith (FIG. 3). As shown, the three sets of suction cups 25 are disposed at 120° intervals such that when one set is positioned adjacent to the hopper 11 in a pick-up position, another set is disposed at the breaking means 15 and the remaining set is disposed at a depositing position over the conveyor 13.

As shown in FIGS. 4 and 5, each set of suction cups 25 is mounted on a vacuum support bar 26 which is disposed parallel to and in radially spaced relation to the shaft 18. Each support bar 26 is in the form of a horizontal member with an elongated slot 27 in which each suction cup 25 is adjustably mounted to move along the length of the bar 26. For this purpose, each suction cup 25 has a hollow threaded stem 28 which is sized to pass through the slot 27 and a pair of lock nuts 29 which are threaded on the stem 28 to lock the suction cups 25 in place. Suitable washers 30 are also employed as shown. Each bar 26 is secured via suitable bolts 31 to perpendicularly disposed mounting plates 32 at each end (FIG. 5). Each plate 32 is, in turn, secured via a cap screw (not shown) to a cam follower support 33 which extends parallel to the slotted bar 26. Each support 33 carries a cam follower 34 which is formed, for example by a stem 35 which is threaded into the support 33 and fixed in place by suitable pin (not shown) and a wheel 36 which is rotatably mounted on the stem 35. In addition, a bearing shaft 37 extends from each cam follower support 33 in parallel relation to each plate 32 radially of the shaft 18. Each bearing shaft 37 is secured in place by a cap screw 37'.

Referring to FIG. 5, the feeder 14 has a means 38 for moving the support bars 26 and this means 38 includes a pair of cams 39 which are mounted on the shaft 18 at respective ends for rotation therewith e.g. by means of a key 40. As shown in FIGS. 3 and 4, each cam 39 is of generally Y-shaped construction and has three acruate slots 41 and three shaped cam slots 42. The cam slots 42 are disposed in the radially outer portions of the legs of each cam 39 while the arcuate slots 41 are radially within the cam slots 42. In addition, a pair of discs 43 are mounted on a hub 44 of a cam 39 (FIG. 5) via a sleeve bearing 45 for relative rotation therewith.

The cam slots 42 (FIG. 3) are sized to receive a respective cam follower roller 36 and are shaped in a curvilinear manner relative to the direction of rotation of the shaft 18 to extend radially outwardly on an increasing radius for a major portion of slot length and radially inwardly on a decreasing radius for a minor trailing portion of slot length. For example, the center of curvature of each cam slot 42 extends over an arc of 29° on an increasing radius of curvature for the first 25° and on a decreasing radius of curvature for the last 4°. The maximum displacement of a cam follower 34 in such a cam slot 42 amounts to 1.00 inches from the base radius, i.e. at the 0° station A of the arc, of for example 3.875 inches. In this example, each cam slot 42 is sized to receive a cam roller 36 of a diameter of 0.625 inches and each cam follower 34 moves with a harmonic motion.

The arcuate slots 41 (FIG. 3) are each disposed on a constant radius, for example 2.50 inches, over an arcuate length L from center-to-center of 36° and have a width of 9/16 inch.

Each disc 43 carries three stop pins 46 (FIG. 3) which are secured in fixed relation thereto on equal radii. Each pin (FIGS. 4 and 5) projects through a respective respective arcuate slot 41 in the adjacent cam 39 for purposes as described below. As indicated in FIG. 3, each pin 46 moves through an endless circular path.

Referring to FIG. 5, each disc 43 carries three bearings blocks 47 in equi-spaced circumferential relaton. These bearing blocks 47 are fixed to the discs 43, for example by screws (not shown) which pass through the discs 43 coaxially of the shaft 18. Each bearing block 47 is provided with a suitable sleeve or antifriction bearing 48 which receives a bearing shaft 37 of a vacuum support bar 26. The bearing 48 is arranged so that the bearing shaft 37 may move radially relative to the shaft 18.

As shown in FIG. 4, each bearing block 47 has a pair of guide plates 49 secured on opposite sides via bolts 50 in order to guide the cam follower support 33 radilly of the shaft.

Referring to FIGS. 3 and 5, a pawl 51 is pivotally mounted on each support path of the stop pins 46 of each disc 43 for sequentially engaging each stop pin 46 during rotation of the shaft 18. Each pawl 51 is shaped to engage with a stop pin 46 in locking manner during rotation of the disc 43. This prevents rotation of the discs 43 with the cams 39 and permits the cam followers 34 and the attached support bars 26 to move radially outwardly of the shaft 18. In addition, each pawl 51 is mounted on a pivot pin 52 which extends through a support 17 via a sleeve bearing 53 and carries a lever 54 on the outside of the support 17. The lever 54 is, in turn, connected by a spring 55 to the support 17. In this way each pawl 51 is spring biased to move into the position as shown in FIG. 3 to lock with a stop pin 46.

In order to lift a pawl 51 from a stop pin 46, each cam 39 carries three circumferentially disposed release rollers 56 and a lifter 57 is secured to each pawl 51 in the path of the rollers 56. As shown in FIG. 4, each release roller 56 is positioned at a trailing end of an arcuate slot 41 for a stop pin 46. In this way, each release roller 56 is adapted to move under and lift a lifter 57 associated with the pawl 51 so as to release the stop pin 46 from the engagement and, thus, allow the discs 43 to again rotate with cams 39.

As shown in FIGS. 3 and 4, each cam 39 also carries three fixedly mounted posts 58, each of which is connected via a spring 59 to a respective stop pin 46. Upon release of a stop pin 46 from the pawl 51, the springs 59 pull the discs 43 forwardly relative to the cams 39. This causes the cam followers 34 and support bars 26 to retract to the respective rest positions.

In addition, a spring stop assembly 60 is secured to each disc 43 (FIG. 4) to abut against a respective cam 39 during a return motion of the discs 43 relative to the cam 39. As shown, each spring stop assembly 60 includes a block 61 which is secured to a disc 43, for example by a bolt (not shown), a spring plunger 62 which is mounted in the block 61 in suitable fashion and a jam nut 63 which maintains the spring plunger 62 in the block 61. The spring plunger 62 is aligned with a leg of the adjacent cam 39 so that when the disc 43 moves forwardly relative to the cam 39, the spring plunger 62 resiliently absorbs the impact forces to ease the impact of the stop pins 46 against the cams 39.

Referring to FIG. 5, a pneumatic means 64 is connected to the suction cups 25 for selectively drawing a vacuum in the cups 25. To this end, the pneumatic means 64 includes a rotary joint 65 which is mounted in one end of the shaft 18, a plurality of tubes 66 (i.e. three) which are mounted inside the shaft 18, and flexible conduits 67 which communicate each tube 66 with a set of suction cups 25 on a support bar 26. As shown, one end of each tube 66 is plugged by a suitable cap 68 while the opposite end is fitted into the rotary joint 65.

As shown in FIG. 8, the rotary joint 65 includes a pair of relatively rotatable members one of which is in the form of a female valve body member 69 fixed to the shaft 18 via a locking screw 70 and the other of which is in the form of a male body member 71. The female body member 69 (FIGS. 9 and 11) is provided with three parallel passages 72 each of which receives a reduced end of a vacuum tube 66 in sealed relation via a suitable seal ring 73. The female body member 69 also has a central bore 74 in which a bearing sleeve 75 is seated. As shown, the bearing sleeve 75 has a flange 76 of triangular shape to permit fitting within the passages 72 and vacuum tubes 66.

The male body member 71 has a stem 77 which is rotatably received in the sleeve 75 as well as two parallel ports 78 which extend therethrough and are fitted with suitable connecting tubes 79 (FIG. 8) for connection with a vacuum source (not shown). In addition, the male member 71 has a pair of arcuate recesses 80 e.g. ¼ inch wide, (FIGS. 9 and 10) which face the female member 69 and are arcuately spaced from each other, for example, by a distance of 1/16 inch at a minimum. Each recess 80 is in communication with a respective port 78 and extends over an arcuate length less then the arcuate length between two adjacent vacuum tubes 66. In addition, a vent port 81 extends through the male member 71. The angular relationship between the ports 78, recesses 80 and vent 81 are shown in FIG. 10.

In addition, a bearing seal 82 in the form of a nylon ring is interposed between the two members 69, 71. As shown in FIG. 9, this seal ring 82 includes two arcuate slots 83 which conform to the shaft of the recesses 80 in the base of the male member 71. In addition, a pin 84 is fixedly secured as by pressfit arrangement in the face of the male member 71 and extends through the seal ring 82 in order to fix the seal ring 82 against rotation relative to the male member 71 to permit fitting within the passages 72 and vacuum tubes 66.

As shown in FIG. 8, a bolt 85 extends through the members 69, 71 and has a head 86 which abuts via a washer 87 against the bearing sleeve flange 76 in the female member 69. The oppoosite end of the bolt 85 carries a washer 88 and a nut 89 as well as a spring 90. As shown, the spring 90 is held in place between the washer 88 and the male member 71. Any slack between the two members 69, 71 of the rotary joint 65 is taken up by the spring 90. The nut 89 is tightened on the bolt 85 an amount sufficient to permit rotation between the two members 69, 71.

Figures 9, 10, 11:
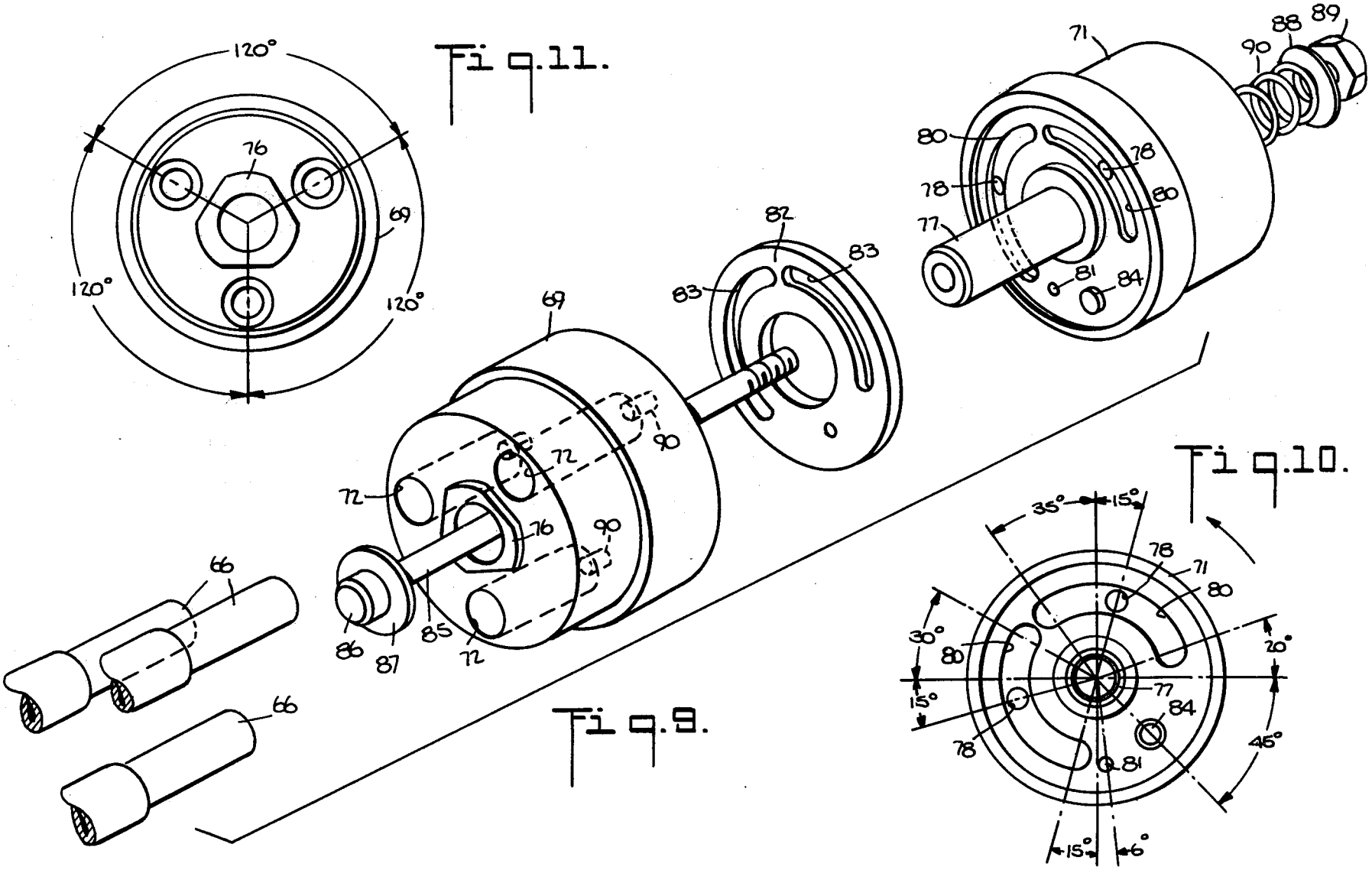
FIG. 9 illustrates an exploded view of the rotary joint of FIG. 8.
FIG. 10 illustrates an end view of a male member of the rotary joint of FIG. 9.
FIG. 11 illustrates an end view of a female member of the rotary joint of FIG. 9.
Figure 19:
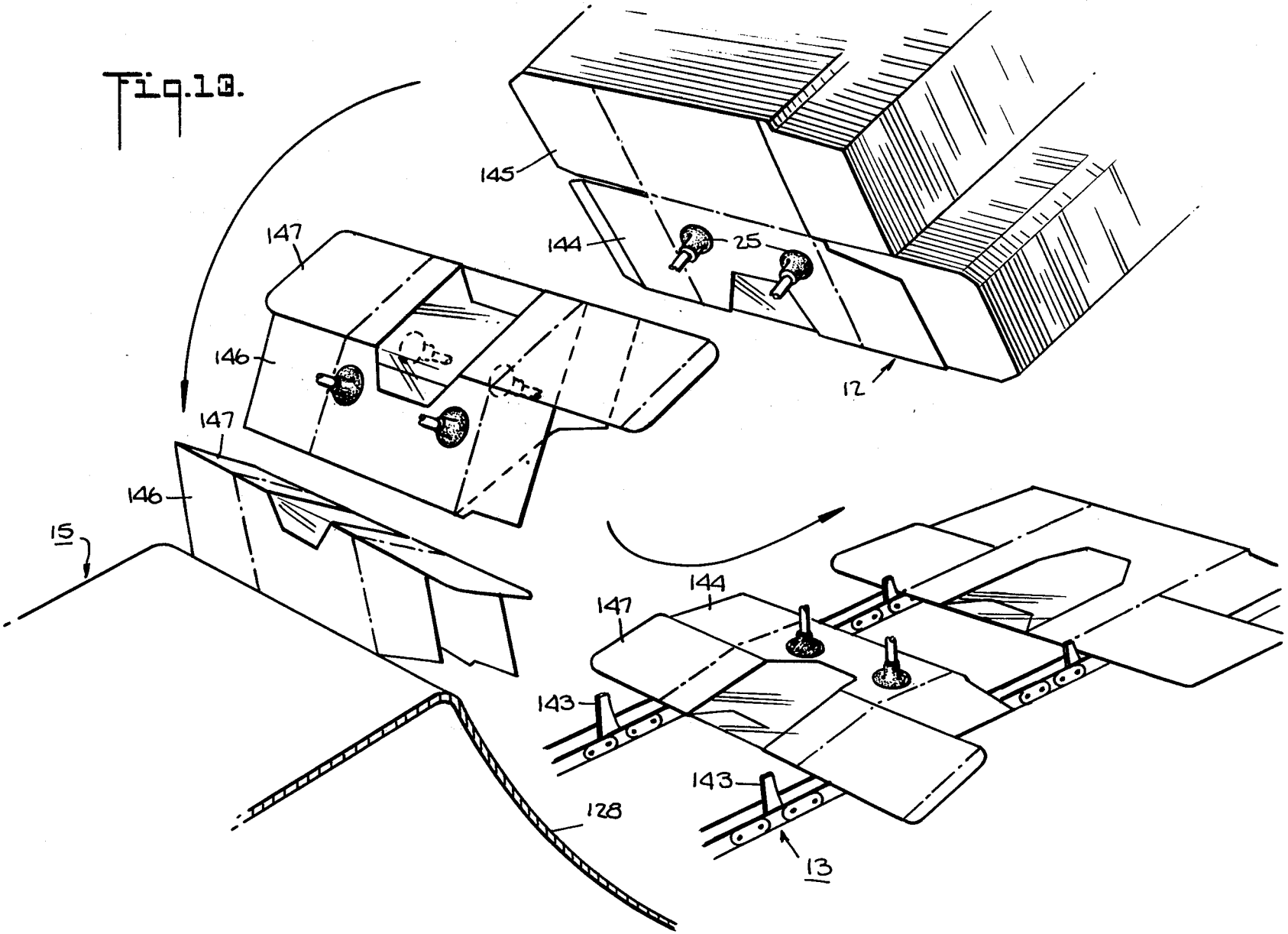

As shown in FIG. 9, each passage 72 through the female member 69 has a reduced portion 90 which is of the same inside diameter as the inside diameter of a vacuum tube 66 in communication there with.

Referring to FIG. 5, the male vacuum body 71 is encompassed by a split collar 91 which carries a depending lever 92. The split collar 91 is clamped about the body member 71 and the lever 92 is secured by a volt 93 to a plate 94 fixed to the frame support 17. The lever 92 is slotted in an arcuate manner (FIG. 2) to permit arcuate adjustment about the axis of the shaft 18 and, thus, the male vacuum body member 71. In this way, the vacuum phasing of the male body member 71 can be adjusted with respect to the hopper 11, breaking means 15 and conveyor 13.

Referring to FIG. 5, each vacuum tube 66 is provided with a plurality of hollow radial tubes 95 which have an internal thread and which communicate with the interior of the vacuum tube. In addition, a threaded hollow stem 96 is threaded at one end into each tube 95 and held in place by a lock nut 97 while the opposite end is fitted into a flexible conduit 67 communicating with the stem 29 of a suction cup 25. The length of the conduit 67 is sufficient to maintain communication between the suction cup 25 and vacuum tube 66 during radial motion of the vacuum support bar 26.

In case a radial tube 95 is not used, a cover 98 in the form of a threaded bolt is threaded into the tube 95 and received in a recess 99 of the shaft 18.

Figure 2:
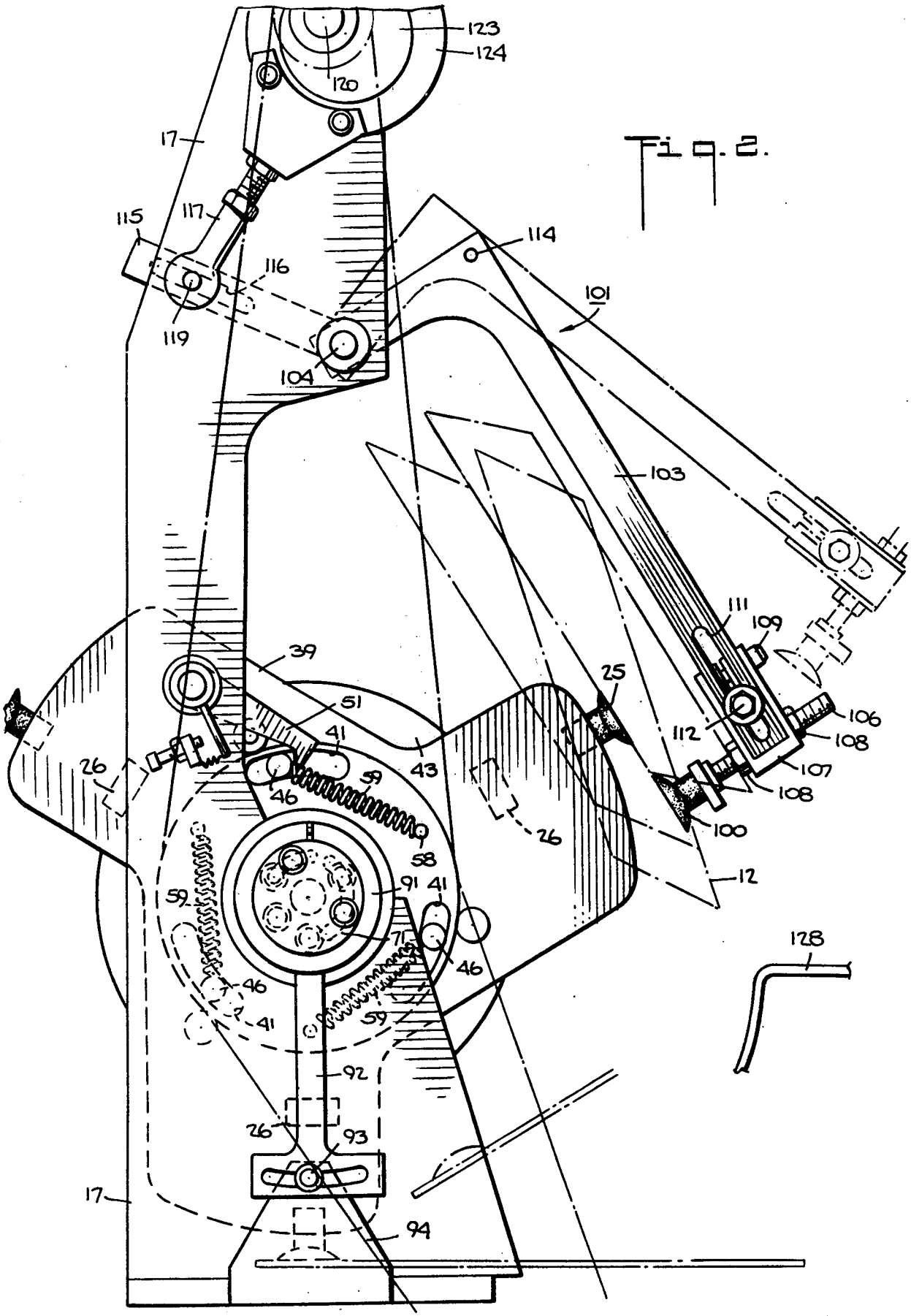
FIG. 2 illustrates a side view of a rotary feeder in accordance with the invention.

Referring to FIG. 2 and 4, the rotary feeder 14 also includes an additional set of suction cups 100 which are mounted above the breaking means 15 and which are directed towards the shaft 18 as well as a means 101 for moving this additional set of suction cups 100 towards the shaft. As shown in FIGS. 1 and 2, this latter means 101 includes a support shaft 102 which extends parallel to the main shaft to support the cups 100, a pair of L-shaped brackets 103 which support the shaft 102 from a pivot shaft 104 rotatably mounted via bearings 105 at each end in the support 17, and means for oscillating the pivot shaft 104.

Each suction cup 100 is mounted on a hollow threaded stem 106 (FIG. 2) which is threaded through a clamp 107 and held in place by locking nuts 108. Each clamp 107 is, in turn, made of split construction, is disposed about the support shaft 102 and is clamped thereon by means of a clamping bolt 109. Loosening of the clamping bolt 109 allows the associated suction cup 100 to be adjusted longitudinally and circumferentially of the support shaft 102. Each stem 106 of a suction cup 100 is connected by a suitable flexible line 110 (FIG. 4) to an air pump or suction pump (not shown) so that a vacuum can be drawn on a suction cup. Each bracket 103 is provided with an elongated slot 111 which receives an end of the support shaft 102. As shown, the end of the shaft 102 carries a locking screw 112 which passes through the slot 111 and abuts against a washer 113 to hold the shaft 102 in place. Upon loosening of the screw 112, the support shaft 102 may be adjusted within the brackets 103. In addition, a suitable stiffening bar 114 is fixed to and between the two brackets 103.

As shown in FIG. 2, the means for oscillating the pivot shaft 104 includes a lever 115 which has an elongated slot 116 and is connected to the shaft 104 and to an eyelet 117 of an eccentric 118 via a pin 119 which passes through the slot 116 to permit movement of the eyelet 117 along the lever 115. As shown, the eccentric 118 is driven off a rotatable shaft 120 which is rotatably mounted via bearings 121 in the support frame 17 and connected to the transmission chain 24 (FIG. 1) via a gear 122. The eccentric 118 includes an eccentric cam 23 which rotates with the shaft 120 within a split collar 124 secured to the eyelet 117. During rotation of the shaft 120, the eccentric 118 carries out a motion which imparts an oscillating motion to the brackets 103 for the suction cups 100. For example, the eccentric 118 allows the suction cups 100 to have a one inch throw.

The rotating shaft 120 is driven in timed relation to the main shaft 18 i.e. at a three to one ratio.

The opposite end of the rotating shaft 120 carries a cam 125 (FIG. 1) which actuates a switch 126 of a valve 127 (FIG. 4) in the conduit 110 to the suction cups 100. When the eccentric 118 pivots the support shaft 102 to lift the suction cups 100, the cam 125 closes the switch 126 and cuts off the vacuum to the suction cups 100.

Referring to FIGS. 3 and 7, the breaking means 15 is in the form of a sheet metal plate 128 of generally L-shape which is located above the conveyor 13 and adjacent to the rotary feeder 14. As shown, the plate 128 has a corner which projects into the arcuate path of a blank 12 conveyed on the rotary feeder 14 and extends downwardly in an arcuate manner to a plane above the horizontal conveyor 13 to insure guidance of a carton blank 12 being delivered to the conveyor 13.

As shown in FIGS. 6 and 7, a suitable means 129 is provided for adjusting the plate 128 relative to the arcuate path of the carton blanks 12. This adjustment means 129 is mounted on a frame 129' adjacent to the frame 17 for the rotary feeder 14 and includes a horizontal member 130 which extends over and across the conveyor 13 and is secured at each end via bolts 131 to a vertical member 132. Each vertical member 132 is, in turn, slidably mounted in a horizontal bar 133 via a bolt 134 (FIG. 7) so as to be adjusted in a vertical plane. Each horizontal bar 133 is slidably mounted in a guideway 135 of the frame 130 via a bolt 136 so as to be adjusted in a horizontal plane. As shown, the vertical members 132 and horizontal bars 133 can be provided with suitable scales 137, 138 for adjustment of the breaking plate 128 in the vertical and horizontal directions.

Referring to FIGS. 6 and 7, the breaking plate 128 is also provided with a plurality of slots 139 over the horizontal member 130 through which locking bolts 140 can be passed and tightened against wing nuts 141 and washers 142 to secure the plate 129 in place.

Referring to FIG. 1, the horizontal conveyor 13 is provided with a plurality of lugs 143 which are spaced apart at suitable spacings relative to the carton blanks 12 to be received so as to positively move the received carton blanks 12 along the conveyor to a filling station.

The relationship of the ports 78, recesses 80, and the positions of the rotary feeder are indicated in FIG. 12. In this regard, when a blank 12 is to be pulled from the hopper 11, for example, when the hopper 11 is at a 30° angle with respect to a horizontally disposed conveyor 13, the male member 71 of the rotary joint 65 is positioned with the ports A, B as illustrated. Thus, when a vacuum tube 66' rotates into a position at the forward end of the recess 80 about port B, vacuum is drawn into the vacuum tube 66'. This, in turn, draws a vacuum through the suction cups adjacent to the hopper so that a carton blank can be pulled from the hopper 11. As the shaft 18 continues to rotate, the vacuum tube remains in communication with the vacuum via the port B until the vacuum tube moves into the position 66'', i.e. out of communication with the recess 80 associated with the port B and into the recess associated with port A. At this time, vacuum is still drawn through the vacuum tube while the carton blank is engaged on both sides at the breaking station. Subsequently, the vacuum tube moves out of the influence of the recess 80 and the port A into the position 66''' at the lowermost position of the feeder 14. At this time, no vacuum is drawn through the tube 66 so that the carton blank can be deposited onto the conveyor 13 under gravity.

Referring to FIG. 13, for a blank 12 to be opened into a rectangular shape the operation of the rotary feeder is such that the blank 12 is picked up by a set of suction cups 25 from the hopper 11 with the suction cups 25 firmly gripping the lower panel of the two exposed panels 144, 145 of the blank 12*a*. Next, as the feeder rotates the blank to the position 12*b* near the breaking plate 128 the additional set of suction cups 100 are moved into engagement with the now lower panel 146 of the opposite side of the blank. The carton blank is then broken by impinging against the corner of the breaking plate 128. At this time, the suction cups 25, 100 remain in engagement with the carton blank. As the carton blank continues to move with the rotary feeder, the blank breaks on itself so that the blank opens and then closes. The additional set of suction cups 100 then disengage from the blank and the blank remains on the suction cups 25 of the rotary feeder. When the blank reaches the depositing position over the conveyor 13, the engaged panel 144 is the forwardmost panel on the now topside of the blank. Further, the blank no longer remains in a truely flattened condition but is able to spring back somewhat into a slightly opened position. The blank is then picked up by the lugs 143 of the conveyor 13 and conveyed forwardly in the slightly opened condition. Final opening of the blank is carried out by various cams (not shown) on the conveyor.

In operation, the cartoner operates as follows:

Referring to FIG. 3, with the feeder shaft 18 continuously rotating and with the rotary feeder 14 in the position shown, the discs 43 are in a locked condition due to the engagement of each pawl 51 with a locking pin 46. At this time, the cams 39 have moved the three sets of suction cups 25 and support bars 26 radially outwardly of the shaft 18 via the cam slots 42 and cam follower rollers 36. One set of suction cups is in engagement with a blank 12 in the hopper 11; a second set of suction cups 25 is in engagement with a previously removed blank 12' at the breaking plate 128 along with the additional set of cups 100; and a third set of cups 25''' is disposed at the deposit station immediately above the conveyor 13.

Operation of the rotary feeder 14 is explained from this position on.

As the shaft 18 continues to rotate, the release roller 56 of each disc 43 adjacent to the engaged pin 46' lifts the pawl 51 via the lifter 57 away from the pin 46. The disc 46 then springs forward under the influence of the springs 59 attached between the stop pins 46 and the posts 58 on the cams 39 and come to rest when the stop pins 46 engage the ends of the slots 41. During this time, the spring stop assemblies 60 (FIG. 4) cushion the abutment of the discs 43 against the cams 39. At the same time, the cam followers 34 move forwardly and radially inwardly in the cam slots 42. This causes all the suction cups 25 to retract. The suction cups 25 adjacent to the hopper 11 thus move the blank 12 inwardly.

Continued rotation of the shaft 18 brings the blank 12 to a position adjacent to the breaking plate 128. At this time, each pawl 51 engages the next stop pin 46 in the sequence to again stop the disc 43 from rotating and to again cause the support bars to move radially outwardly. At the same time, the eccentric 118 causes the associated suction cups 100 to move towards the shaft 18 to engage the blank 12' above the breaking plate 128. The two sets of suction cups 25', 100 thus firmly engage the blank 12' on opposite sides. Continued rotation causes the forwardmost edge of the blank 12' to impinge on the breaking plate 128 causing the blank 12' to open. Shortly thereafter, the next release roller 56 in each sequence disengages the pawl 51 and the discs 43 again spring forward relative to the rotation of the cams 39. The associated suction cups 100 are also relieved of any suction and disengage from the blank 12'. However, the suction cups 25' of the rotary feeder remain in engagement and continue to convey the open blank 12' downwardly towards the conveyor 13.

As the shaft 18 continues to rotate, the suction support bars 26 are drawn radially inwardly towards the shaft 18 to facilitate movement of the opened blank past the breaking plate 128.

As the blank comes into the lowermost position, each pawl 51 engages the next stop pin 46 in the sequence causing the discs 43 to again stop. At the same time, the vacuum supply of the suction cups 25''' is cut off so that the blank 12''' is able to fall away under gravity onto the conveyor 13. Thereafter, as each pawl 51 is disengaged from the stop pin 46, the discs 43 spring forwardly relative to the cams 39 while the support bars 26 are retracted. The rotary feeder 14 then moves into position to pick up another blank 13 from the hopper 11.

In the event that a blank 12 is not to be picked up, due for example, to a product not being available for packaging in the sequence of blanks delivered to the conveyor 13 a suitable signal can be given to the pneumatic means to cut off the ports A, B of the rotary joint from the vacuum source in sequence to avoid picking up a carton blank. For example, a shown in FIG. 14, if no blank is to be picked up, a signal is given to the vacuum lines to the ports A, B so that no vacuum is drawn in either port. Thus, no blanks can be picked up.

If a blank is merely to be skipped, a signal is given so that only port B is closed while port A remains open. Thus, no blank is pulled from the hopper; however, a blank at the breaking station is held in place by the suction cups thereat and a breaking operation is carried out. As the suction cups without a blank then move into the sphere of influence of port A, a signal is given to cut off the port A from the vacuum source so that vacuum is cut off at the breaking station. However, port B is again connected to the vacuum source so that a blank can be picked up for the following set of suction cups.

Figure 14:
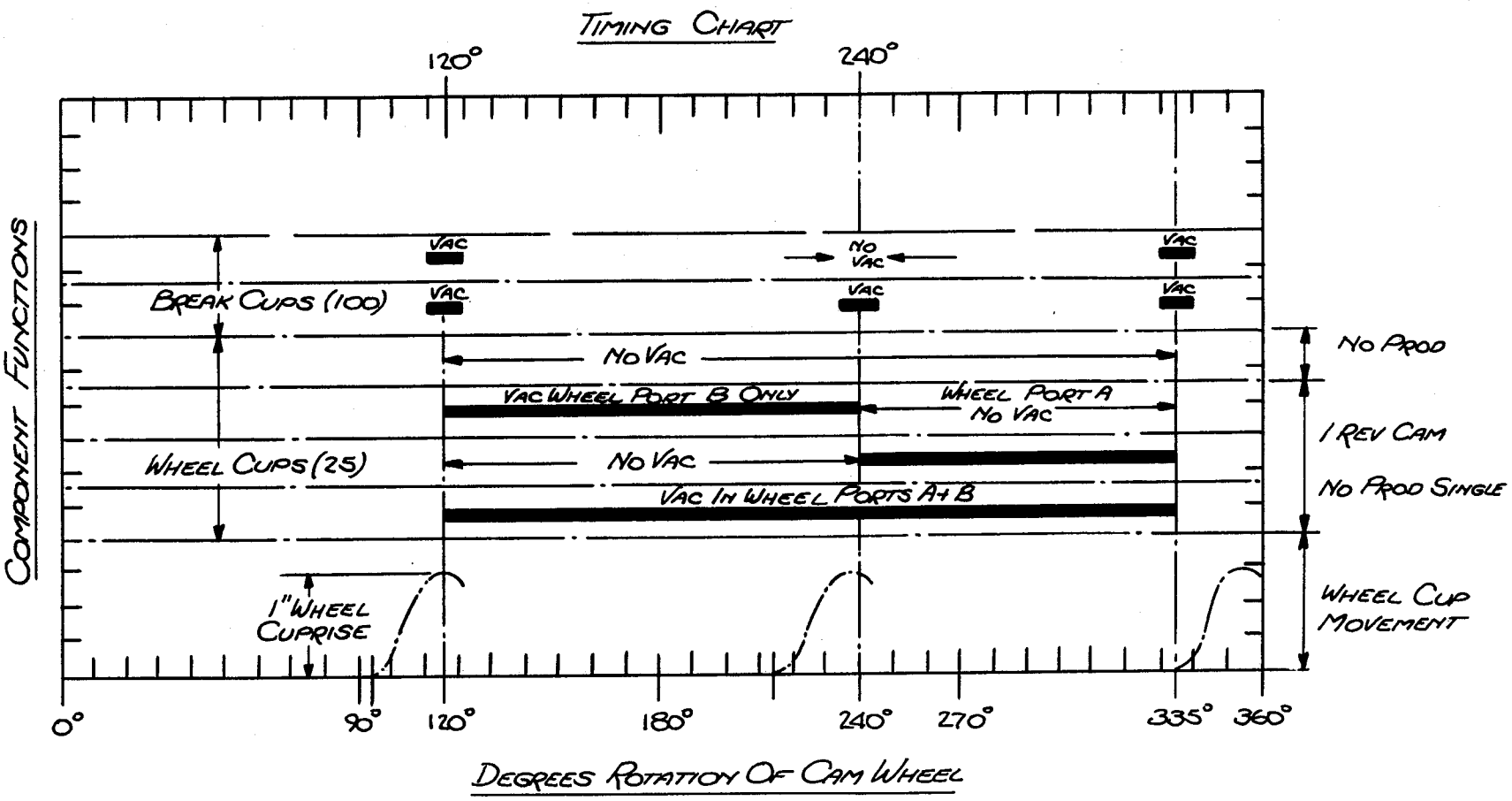
FIG. 14 illustrates a timing chart for the various motions of the rotary feeder in accordance with the invention.

The various motions of the rotary feeder 14 are schematically illustrated in the timing chart of FIG. 14.

The invention thus provides a cartoner which is able to pick up, break and deposit carton blanks on a dead stop basis. This permits a greater degree of reliability than if the blanks were picked up or deposited on the fly.

The invention further provides a relatively simple construction for carrying out breaking of a carton during conveyance to the conveyor. This allows the inherent tendency of a flattened carton blank to remain flat to be overcome.

Because of the adjustability of the suction cups on the support bars, any suitable size of blank can be conveyed within the confines of the rotary feeder. Further, any suitable number of suction cups can be mounted on the vacuum support bars to obtain a greater or less gripping force on a conveyed blank.

What is claimed is:

1. A cartoner comprising a conveyor for conveying a series of carton blanks sequentially from an input end to a packaging station;

a hopper for supplying blanks to said conveyor;

a feeder for sequentially feeding blanks from said hopper through an arcuate path to said input end of said conveyor; said feeder including a rotatable shaft, a support bar extending parallel to and in radially spaced relation to said shaft, at least one set of suction cups mounted on said bar for rotation with said shaft, and means for moving said suction cups radially of said shaft between a rest position and a radially extended position during rotation of said shaft to pick up a carton blank from said hopper, said means including a pair of cams on said shaft at respective ends thereof for rotation therewith, each said cam having at least one arcuate slot and at least one shaped cam slot therein, a pair of discs, each said disc being mounted on a respective cam for relative rotation therewith and being secured to a respective end of said support bar for rotation therewith, a pair of cam followers, each cam follower being secured to a respective end of said support bar and projecting into a respective cam slot of a respective cam, at least one stop pin secured to at least one of said discs and projecting through said arcuate slot of a respective one of said cams for movement in an endless path, and a pawl disposed on a fixed axis in said endless path of said stop pin for engaging said stop pin during rotation of said shaft and said cam to prevent rotation of said discs and said support bar whereby said cam slots direct said cam followers and said support bar radially outwardly of said shaft; and breaking means disposed in said arcuate path for breaking a carton blank impinging thereon on itself.

2. A cartoner as set forth in claim 1 wherein said hopper is angularly disposed above said conveyor to define an acute angle therewith and said arcuate path extends over an angle of 240°.

3. A cartoner as set forth in claim 1 which further comprises a cam release roller on said one cam for releasing said pawl from said stop pin and a spring secured between said stop pin and said one cam for moving said stop pin forwardly in said arcuate slot relative to the direction of rotation of said shaft.

4. A cartoner as set forth in claim 3 which further comprises a spring stop assembly secured to at least one of said discs and disposed in the plane of a respective cam for absorbing a force of impact between said cam and said disc during a forward motion of said stop pin.

5. A cartoner as set forth in claim 1 wherein each cam has a hub mounting a respective disc thereon.

6. A cartoner as set forth in claim 1 which further comprises a pneumatic means connected to said suction cups for drawing a vacuum in said cups.

7. A cartoner as set forth in claim 6 wherein said pneumatic means includes at least one vacuum tube extending within said shaft, means for selectively drawing a vacuum in said tube, and a plurality of flexible conduits, each said conduit extending from said tube to a respective one of said suction cups to communicate said suction cup with said tube.

8. A cartoner as set forth in claim 7 wherein said means for selectively drawing a vacuum includes a rotary joint at one end of said shaft for connecting said vacuum tube to a vacuum source.

9. A cartoner as set forth in claim 1 wherein said feeder further includes a second set of suction cups mounted above said breaking means and directed towards said shaft, and means for moving said second set of suction cups towards said one set of suction cups on said shaft when said one set of suction cups approaches said breaking means to hold a carton blank on opposite sides thereof.

10. A cartoner as set forth in claim 9 wherein said means for moving said second set of suction cups includes a pivotally mounted bracket having said second set of suction cups thereon and an eccentric for pivoting said bracket.

11. A cartoner as set forth in claim 10 which further includes a transmission connected to said eccentric for driving said shaft and said eccentric in timed relation.

12. A cartoner as set forth in claim 1 wherein said breaking means is a plate above said conveyor and adjacent said feeder, said plate having a corner projecting into said arcuate path.

13. A cartoner as set forth in claim 12 which further includes means for adjusting said plate relative to said arcuate path.

14. A cartoner as set forth in claim 1 wherein said breaking means is a plate disposed at a mid-point of said arcuate path.

15. A cartoner comprising a conveyor for conveying a series of carton blanks sequentially from an input end to a packaging station;

a hopper for supplying blanks to said conveyor;

a rotary feeder for sequentially feeding blanks from said hopper through an arcuate path to said input end of said conveyor, said rotary feeder including a rotatable shaft, three sets of suction cups mounted circumferentially about said shaft in equi-spaced relation for rotation therewith a plurality of support bars parallel to and in radially spaced relation to said shaft, each bar having a respective set of suction cups mounted thereon and means for moving said suction cups radially of said shaft between a rest position and a radially extended position during rotation of said shaft, said means including a pair of cams mounted on said shaft at respective ends thereof for rotation therewith, each said cam having three arcuate slots and three shaped cam slots therein, a pair of discs, each disc being mounted on a respective cam for relative rotation therewith and being secured to a respective end of each said support bar for rotation therewith, a pair of cam followers on each support bar, each cam follower being secured to a respective end of a respective support bar and projecting into a respective cam slot of a respective cam, three stop pins secured to each disc and projecting through a respective arcuate slot of a respective cam for movement in an endless path, and a pawl disposed on a fixed axis in said endless path of said stop pins of each disc for sequentially engaging each stop pin during rotation of said shaft to prevent rotation of said discs with said cams whereby said cam slots direct said cam followers and said support bars radially outwardly of said shaft.

16. A cartoner as set forth in claim 15 wherein said means for moving said suction cups moves said sets of suction cups simultaneously.

17. A cartoner as set forth in claim 15 which further comprises three cam release rollers on each cam for sequentially releasing each said pawl from a stop pin and a plurality of springs, each spring being secured between a respective stop pin and a respective cam for moving said discs forwardly relative to said cams.

18. A cartoner as set forth in claim 15 which further comprises a pneumatic means connected to said suction cups for selectively drawing a vacuum in said cups.

19. A cartoner as set forth in claim 15 wherein said feeder further includes a fourth set of suction cups mounted above said breaking means and means for moving said fourth set of cups towards said shaft when one of said three sets of suction cups approaches said breaking means to hold a carton blank on opposite sides thereof.

20. A cartoner as set forth in claim 15 wherein said breaking means is located at the mid-point of said arcuate path, and wherein said feeder further includes a fourth set of suction cups mounted above said breaking means and means for moving said fourth set of cups towards said shaft when one of said three sets of suction cups approaches said breaking means to hold a carton blank on opposite sides thereof.

21. A cartoner as set forth in claim 20 wherein said means for moving said fourth set of suction cups moves said fourth set of suction cups away from said shaft when one of said three sets of cups moves past said breaking means to facilitate opening of a carton blank therebetween.

22. A cartoner as set forth in claim 21 which further includes a pneumatic means for drawing a vacuum in one of said three sets of cups and said fourth set of cups during movement of a carton past said breaking means.

* * * * *

UNITED STATES PATENT AND TRADEMARK OFFICE

CERTIFICATE OF CORRECTION

PATENT NO. : 4,211,153

DATED : July 8, 1980

INVENTOR(S) : Robert W. Walters and James Nylander

It is certified that error appears in the above—identified patent and that said Letters Patent is hereby corrected as shown below:

Column 1, line 27, change "cartone" to -- cartoner --.

Column 1, line 45, change "operator" to -- operating --.

Column 2, line 61, change "eposit" to -- deposit --.

Column 5, lines 5 & 6, delete second occurrence of "respective".

Column 5, line 10, change "relaton" to -- relation --.

Column 6, line 40, change "shaft" to -- shape --.

Column 6, line 66, change "volt" to -- bolt --.

Signed and Sealed this

*Eighteenth* Day of *November 1980*

[SEAL]

*Attest:*

SIDNEY A. DIAMOND

*Attesting Officer*

*Commissioner of Patents and Trademarks*